US012685895B2

(12) United States Patent
Kawada

(10) Patent No.: US 12,685,895 B2
(45) Date of Patent: Jul. 21, 2026

(54) MANAGEMENT SYSTEM, METHOD, AND STORAGE MEDIUM

(71) Applicant: TOYOTA JIDOSHA KABUSHIKI KAISHA, Toyota (JP)

(72) Inventor: Norihiko Kawada, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 957 days.

(21) Appl. No.: 17/807,557

(22) Filed: Jun. 17, 2022

(65) Prior Publication Data

US 2023/0026349 A1 Jan. 26, 2023

(30) Foreign Application Priority Data

Jul. 26, 2021 (JP) ..... 2021-121382

(51) Int. Cl.
*A63B 23/04* (2006.01)

(52) U.S. Cl.
CPC ..... *A63B 23/0464* (2013.01); *A63B 23/047* (2013.01)

(58) Field of Classification Search
CPC ..... A63B 23/0464; A63B 23/047
See application file for complete search history.

(56) References Cited

U.S. PATENT DOCUMENTS

| | | | | |
|---|---|---|---|---|
| 6,572,512 | B2 * | 6/2003 | Anderson | A63B 22/0207 482/54 |
| 10,286,286 | B1 * | 5/2019 | Ryan | A63B 71/0054 |
| 2017/0049660 | A1 | 2/2017 | Sugata | |
| 2017/0128769 | A1 | 5/2017 | Long et al. | |
| 2019/0083351 | A1 * | 3/2019 | Suzuki | A61H 3/008 |
| 2021/0358615 | A1 | 11/2021 | Kawada | |

FOREIGN PATENT DOCUMENTS

| | | | |
|---|---|---|---|
| JP | 2009/112337 | A | 5/2009 |
| JP | 6554996 | B2 | 8/2019 |
| JP | 2021-178120 | A | 11/2021 |

* cited by examiner

*Primary Examiner* — Jay Trent Liddle
*Assistant Examiner* — Jose Angeles
(74) *Attorney, Agent, or Firm* — Oblon, McClelland, Maier & Neustadt, L.L.P.

(57) ABSTRACT

A management system for managing a walk training apparatus according to one aspect of the present disclosure includes: a state detecting portion configured to detect a loaded state in which the user applies a load to the walk training apparatus during use of the walk training apparatus; an evaluation value calculating portion configured to calculate an evaluation value based on which the load applied to the walk training apparatus by the user is evaluated; and a timing determination portion configured to, in a case where the evaluation value is equal to or more than a threshold associated with the walk training apparatus, determine that a timing of maintenance of the walk training apparatus has come.

11 Claims, 7 Drawing Sheets

| WALK TRAINING APPARATUS ID | THRESHOLD | NOTIFICATION DESTINATION INFORMATION |
|---|---|---|
| TRD_0001 | 420000 | abc@abc.com |
| TRD_0002 | 350000 | dem@dem.com |
| TRD_0003 | 600000 | abc@abc.com |
| ⋮ | ⋮ | ⋮ |

MANAGEMENT SYSTEM, METHOD, AND STORAGE MEDIUM

CROSS-REFERENCE TO RELATED APPLICATION

This application claims priority to Japanese Patent Application No. 2021-121382 filed on Jul. 26, 2021, incorporated herein by reference in its entirety.

BACKGROUND

1. Technical Field

The present disclosure relates to a management system, a method, and a storage medium for a walk training apparatus.

2. Description of Related Art

In the related art, various walk training apparatuses configured to perform walking training for patients have been proposed for the purpose of rehabilitation for lower limb paralysis or the like. For example, Japanese Patent No. 6554996 (JP 6554996 B) describes a walk training apparatus configured to determine a swinging start of a leg of a user wearing the walk training apparatus based on the position of the center of a load applied to the sole of the user during a gait operation of the user.

SUMMARY

Generally, in a case where the user performs walking training by use of the walk training apparatus, a connecting tool such as a belt or a harness via which the walk training apparatus is connected to the user is attached to the user, so that the user is supported by the connecting tool from the upper side. When the user performs walking training, a load is applied to the connecting tool, so that the connecting tool might break or deteriorate. Accordingly, it is necessary to grasp a timing of maintenance of the walk training apparatus based on the load applied to the walk training apparatus by the user.

However, the walk training apparatus described in JP 6554996 B has not been devised for the purpose of solving such a problem. Accordingly, the walk training apparatus described in JP 6554996 B has such a problem that a timing of maintenance of the walk training apparatus cannot be determined based on the load applied to the walk training apparatus by the user.

The present disclosure is achieved in order to solve such a problem, and an object of the present disclosure is to provide a management system, a method, and a storage medium each of which can determine a timing of maintenance of a walk training apparatus based on a load applied to the walk training apparatus by a user.

A management system for managing a walk training apparatus for a user to perform walking training, according to one aspect, includes a state detecting portion, an evaluation value calculating portion, and a timing determination portion. The state detecting portion is configured to detect a loaded state in which the user applies a load to the walk training apparatus during use of the walk training apparatus. The evaluation value calculating portion is configured to calculate an evaluation value based on which the load applied to the walk training apparatus by the user is evaluated. The timing determination portion is configured to, in a case where the evaluation value is equal to or more than a threshold associated with the walk training apparatus, determine that a timing of maintenance of the walk training apparatus has come.

The state detecting portion may detect a fall of the user during use of the walk training apparatus. The evaluation value may be an integrated load based on the number of times of the fall of the user and a predetermined load.

The predetermined load may be equal to or more than a load to be applied by the user to a connecting tool via which the user is connected to the walk training apparatus.

The state detecting portion may detect a fall of the user during use of the walk training apparatus. The evaluation value may be an integrated load based on the number of times of the fall of the user and the load applied by the user to the walk training apparatus when the user falls.

The load applied to the walk training apparatus may be a load applied by the user to a connecting tool via which the user is connected to the walk training apparatus.

The state detecting portion may detect a fall of the user during use of the walk training apparatus. The evaluation value may be the number of times of the fall of the user.

The threshold may be a value based on durability of a connecting tool via which the user is connected to the walk training apparatus.

The state detecting portion may detect the loaded state based on a posture change of the user by use of a captured image of the user using the walk training apparatus.

The state detecting portion may detect the loaded state based on a change in a load of the user, the load being output from a load measurement device configured to measure the load of the user.

The walk training apparatus may include a supporting device configured to support the user from an upper side via a connecting tool attached to the user. The state detecting portion may detect the loaded state based on a load applied by the user to the supporting device via the connecting tool.

A method according to one aspect of the disclosure includes: a computer detecting a loaded state in which a user applies a load to a walk training apparatus during use of the walk training apparatus; the computer calculating an evaluation value based on which the load applied by the user to the walk training apparatus is evaluated; and the computer determining that a timing of maintenance of the walk training apparatus has come, in a case where the evaluation value is equal to or more than a threshold associated with the walk training apparatus.

A storage medium according to one aspect of the disclosure stores a program that causes a computer to execute the following steps: a step of detecting a loaded state in which a user applies a load to a walk training apparatus during use of the walk training apparatus; a step of calculating an evaluation value based on which the load applied to the walk training apparatus by the user is evaluated; and a step of, in a case where the evaluation value is equal to or more than a threshold associated with the walk training apparatus, determining that a timing of maintenance of the walk training apparatus has come.

With the present disclosure, it is possible to provide a management system, a method, and a storage medium each of which can determine a timing of maintenance of a walk training apparatus based on a load applied by a user to the walk training apparatus.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
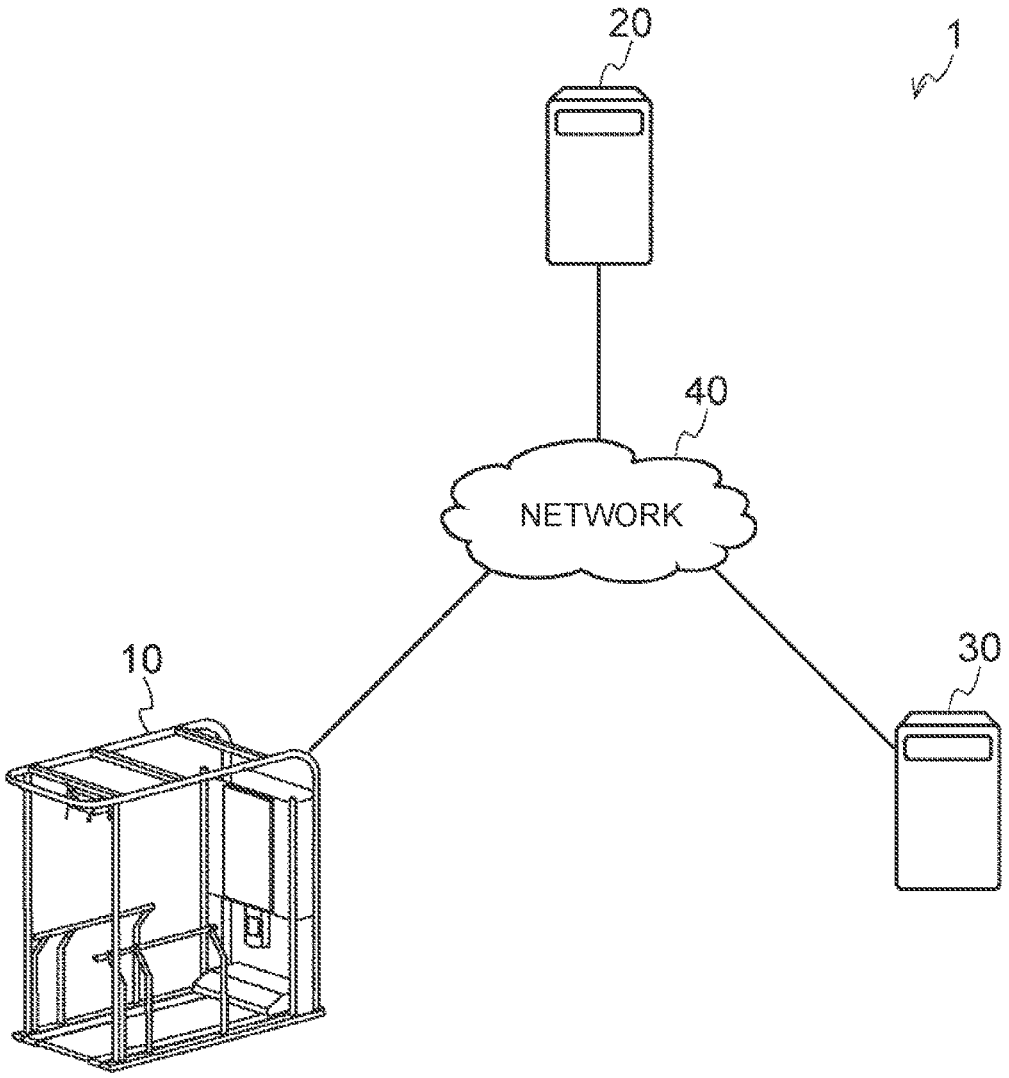
FIG. 1 is a view illustrating a management system according to one aspect of the present disclosure.

The following will describe a management system according to one embodiment of the present disclosure with reference to the drawings. FIG. 1 is a view illustrating a management system 1 according to one embodiment of the present disclosure. The management system 1 is a system configured to manage a walk training apparatus 10. The management system 1 includes a walk training apparatus 10, a management apparatus 20, and a notification destination apparatus 30. The walk training apparatus 10, the management apparatus 20, and the notification destination apparatus 30 can mutually perform data communication via a network 40.

The walk training apparatus 10 is an apparatus for a user to perform walking training. The walk training apparatus 10 can be provided in a place such as a hospital or a rehabilitation facility. The walk training apparatus 10 provides log information on the walk training apparatus 10 to the management apparatus 20. Details of the walk training apparatus 10 will be described with reference to FIGS. 2 to 5.

The management apparatus 20 is an apparatus configured to manage the walk training apparatus 10. The management apparatus 20 can be provided in the manufacturer or the like of the walk training apparatus 10. The management apparatus 20 determines a timing of maintenance of the walk training apparatus 10. When the timing of maintenance of the walk training apparatus 10 comes, the management apparatus 20 transmits, to the notification destination apparatus 30, a notification indicating that the timing has come. Details of the management apparatus 20 will be described with reference to FIG. 6.

The notification destination apparatus 30 is an apparatus configured to receive, from the management apparatus 20, the notification indicating that the timing of maintenance of the walk training apparatus 10 has come. The notification destination apparatus 30 can be provided in a company or the like that performs maintenance of the walk training apparatus 10.

Figure 2:
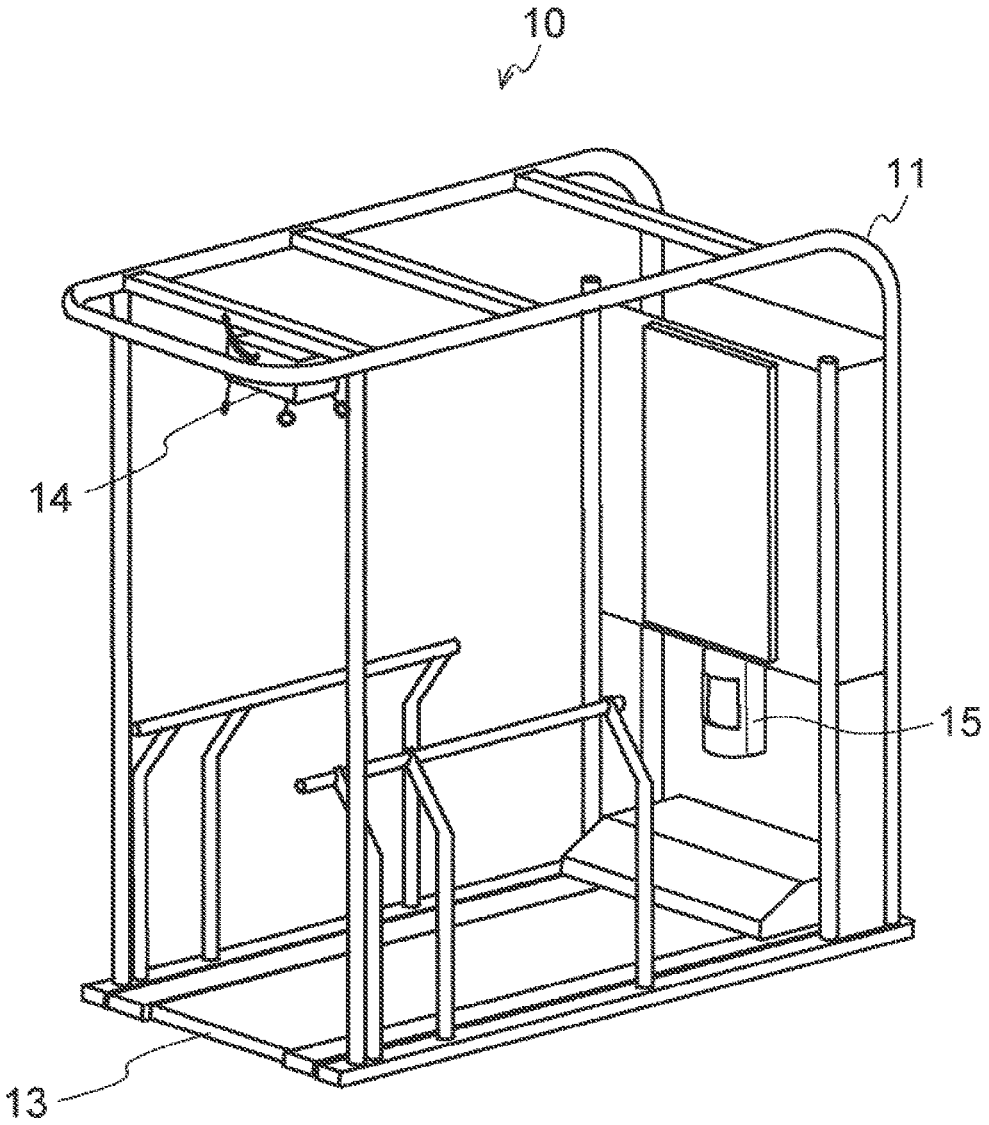
FIG. 2 is a perspective view illustrating a walk training apparatus according to one aspect of the present disclosure.

FIG. 2 is a perspective view illustrating the walk training apparatus 10 according to one embodiment of the present disclosure. The walk training apparatus 10 includes a main body 11, a control device 12 (not illustrated), a treadmill 13, a suspension relief device 14, a camera unit 15, and load measurement devices 161 (not illustrated).

The main body 11 is a support structure of the walk training apparatus 10. The control device 12 is a device configured to control the whole walk training apparatus 10. The treadmill 13 is a device on which a user walks and includes a turning member configured to turn in accordance with the pace of the user.

The suspension relief device 14 is a supporting device configured to support the user from the upper side via a connecting tool. The connecting tool includes a harness and a belt. The harness is attached to a body part of the user such as waist. A first end of the belt is connected to the harness, and a second end of the belt is connected to the suspension relief device 14. The suspension relief device 14 supports the user from the upper side via the belt and the harness connected as such.

The camera unit 15 includes an image sensor configured to capture an image of the user. The camera unit 15 is provided at a position where an image of the user using the walk training apparatus 10 can be captured.

Figure 3:
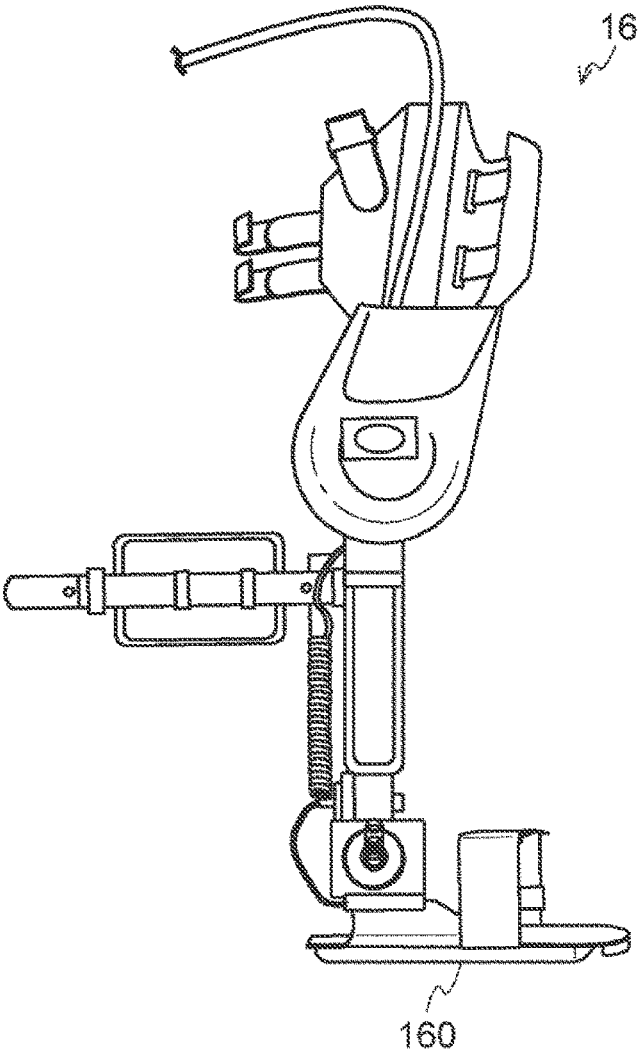
FIG. 3 is a side view illustrating one example of a walking assist device according to one aspect of the present disclosure.

FIG. 3 is a side view illustrating one example of a walking assist device 16 according to one embodiment of the present disclosure. The walking assist device 16 is a device attached to a leg of the user so as to assist walking of the user. The walking assist device 16 includes a bottom portion 160. A foot of the user is put on the top surface of the bottom portion 160.

Figure 4:
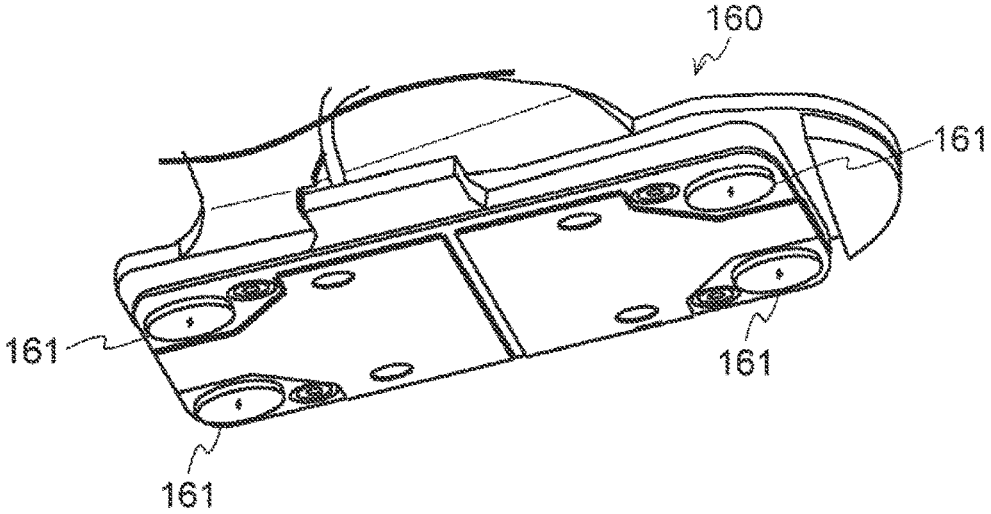
FIG. 4 is a perspective view illustrating a bottom portion of the walking assist device according to one aspect of the present disclosure.

FIG. 4 is a perspective view illustrating the bottom portion 160 of the walking assist device 16. The load measurement devices 161 are provided in the bottom portion 160. The load measurement device 161 is a device configured to measure a load applied to the walk training apparatus 10 by the user wearing the walking assist device 16 during use of the walk training apparatus 10. A concrete example of the load measurement device 161 includes a load sensor or the like configured to detect a load applied to the bottom portion 160 in its vertical direction, for example.

Note that the number of the load measurement devices 161 and the positions of the load measurement devices 161 are not limited to the example illustrated in FIG. 4, and a given number of the load measurement devices 161 can be set at given positions in the bottom portion 160. Further, the load measurement devices 161 may be provided right under the treadmill 13 so as to measure a load applied to the walk training apparatus 10 by the user during use of the walk training apparatus 10.

Figure 5:
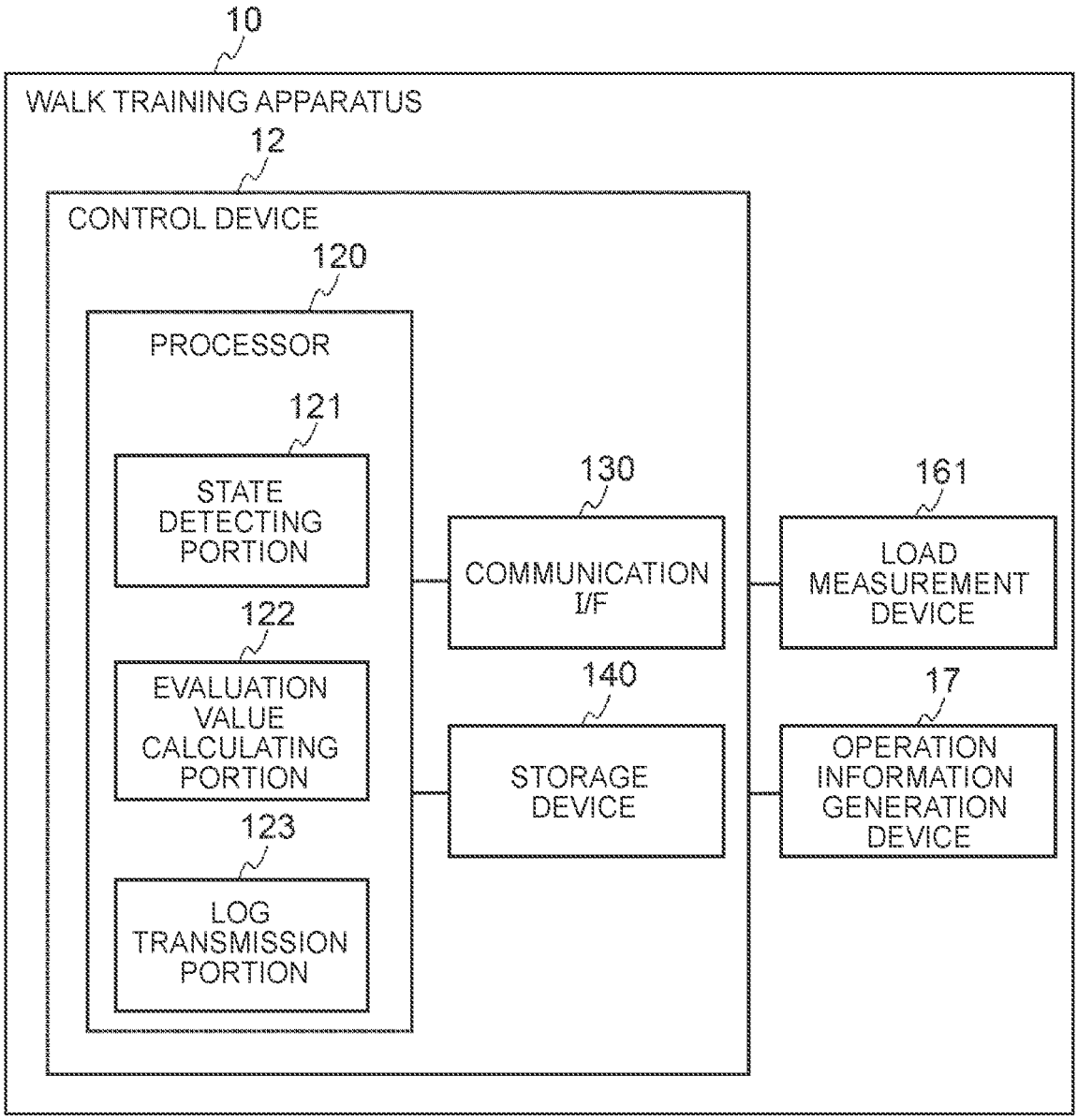
FIG. 5 is a view illustrating a configuration of the walk training apparatus according to one aspect of the present disclosure.

FIG. 5 is a view illustrating a configuration of the walk training apparatus 10. The walk training apparatus 10 includes the control device 12, the load measurement devices 161, and an operation information generation device 17.

The operation information generation device 17 is a device configured to acquire operation information indicative of the operation of the user. A concrete example of the operation information generation device 17 is, for example, an image sensor or the like. The image sensor captures an image of the user using the walk training apparatus 10 to form a captured image and outputs the captured image. The captured image corresponds to the operation information.

The control device 12 is a device configured to control the whole walk training apparatus 10. The control device 12 includes a processor 120, a communication interface (I/F) 130, and a storage device 140.

The communication interface 130 is a device configured to performing data communication between the control device 12 and other devices. The communication interface 130 can perform data communication between the load measurement devices 161 and the operation information generation device 17. Further, the communication interface 130 can perform data communication between the management apparatus 20 and the notification destination apparatus 30 via the network 40. The storage device 140 is a device in which various pieces of information such as a program to be processed by the control device 12 are stored.

The processor 120 is a device configured to read out a program from the storage device 140 and execute the program. Concrete examples of the processor 120 include a central processing unit (CPU) and a micro processing unit (MPU), for example. The program to be executed by the processor 120 includes a state detecting portion 121, an evaluation value calculating portion 122, and a log transmission portion 123. Note that these programs may be executed by an integrated circuit such as a field-programmable gate array (FPGA) or an application specific integrated circuit (ASIC). The control device 12, the processor 120, and the integrated circuit correspond to a computer.

The state detecting portion 121 is a program configured to detect a loaded state in which the user using the walk training apparatus 10 can apply a load to the walk training apparatus 10, by use of operation information generated by the operation information generation device 17. The loaded state includes, for example, a fall of the user. Accordingly, the state detecting portion 121 can detect a fall of the user using the walk training apparatus 10. The state detecting portion 121, the processor 120 including the state detecting portion 121, and the control device 12 correspond to a state detecting portion. Further, the processor 120 and the control device 12 correspond to a computer.

The state detecting portion 121 can detect the loaded state based on a posture change of the user by use of the captured image of the user using the walk training apparatus 10. For example, the state detecting portion 121 analyzes the captured image of the user, and when the posture of the user during walking changes to a falling posture of the user, the state detecting portion 121 determines that the user has fallen down.

Further, the state detecting portion 121 can detect the loaded state based on a change in a load of the user that is output from the load measurement device 161. For example, the state detecting portion 121 analyzes the load of the user that is output from the load measurement device 161, and when the load of the user suddenly decreases, the state detecting portion 121 can determine that the user has fallen down. More particularly, when a decrease width of the load of the user per unit time exceeds a predetermined threshold, the state detecting portion 121 can determine that the user has fallen down. The predetermined threshold can be determined based on a decrease width in load that is expected at the time when the user falls down.

Further, the state detecting portion can detect the loaded state based on a load applied to the suspension relief device 14 by the user. For example, the state detecting portion 121 analyzes a load of the user that is measured by the suspension relief device 14, and when the load of the user suddenly increases, the state detecting portion 121 can determine that the user has fallen down. More particularly, when an increase of the load of the user per unit time exceeds a predetermined threshold, the state detecting portion 121 can determine that the user has fallen down. The predetermined threshold can be determined based on an increase in load that is expected at the time when the user falls down.

The evaluation value calculating portion 122 is a program configured to calculate an evaluation value based on which a load to the walk training apparatus 10 by the user is evaluated. In the present embodiment, an integrated load based on the number of times of the fall of the user and a predetermined load is employed as the evaluation value. The evaluation value calculating portion 122, the processor 120 configured to implement the evaluation value calculating portion 122, and the control device 12 including the processor 120 correspond to an evaluation value calculating portion.

As the predetermined load, it is preferable to employ a value equal to or more than a load that can be applied by the user to the connecting tool (the belt, the harness, or the like) via which the user is connected to the walk training apparatus 10. More specifically, the predetermined load can be determined based on the weight of the user in a state where the user wears the walking assist device 16. Since, at the time of the fall, a load equal to or more than the weight of the user wearing the walking assist device 16 is applied to the connecting tool, it is preferable to employ a load several times as large as the weight of the user wearing the walking assist device 16. For example, in a case where the weight of the user wearing the walking assist device 16 is 105 kg, about 4200 N that is more than four times as large as the weight can be employed as the predetermined load. When the state detecting portion 121 detects the fall of the user, the evaluation value calculating portion 122 integrates the predetermined load and calculates the integrated load as the evaluation value.

The log transmission portion 123 is a program configured to transmit log information on the walk training apparatus 10 to the management apparatus 20. The log information includes identification information on the walk training apparatus 10 and an evaluation value calculated by the evaluation value calculating portion 122.

Figures 6, 7:
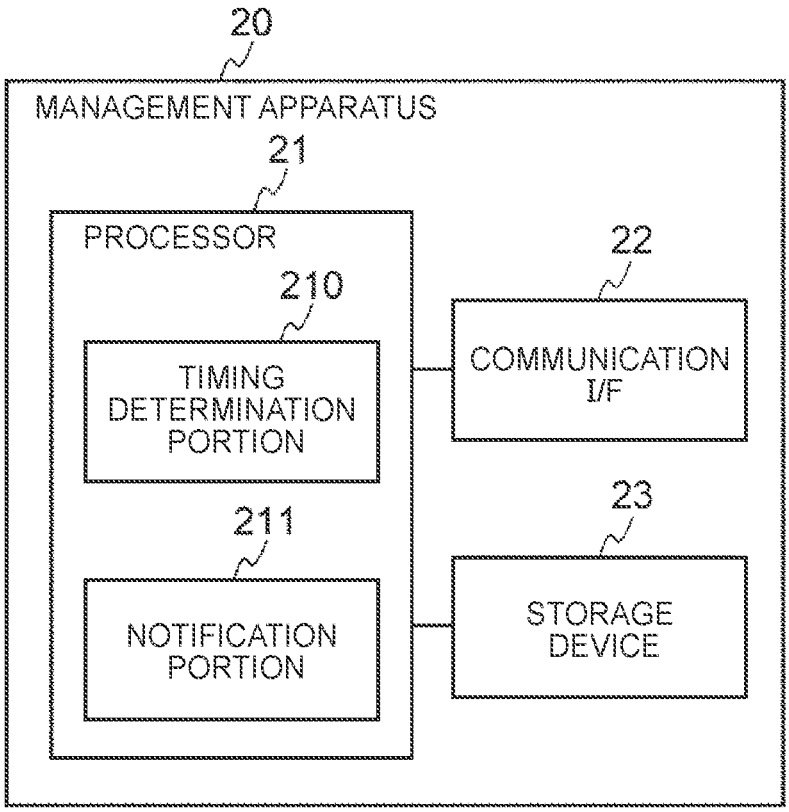
FIG. 6 is a view illustrating a configuration of a management apparatus according to one aspect of the present disclosure.
FIG. 7 is a view illustrating one example of management information stored in the management apparatus according to one aspect of the present disclosure.

FIG. 6 is a view illustrating a configuration of the management apparatus 20. The management apparatus 20 includes a processor 21, a communication interface 22, and a storage device 23.

The communication interface 22 is a device configured to perform data communication between the management apparatus 20 and other devices. The communication interface 22 can perform data communication between the walk training apparatus 10 and the notification destination apparatus 30 via the network 40.

The storage device 23 is a device in which various pieces of information such as a program and a data table to be processed by the processor 21 are stored. FIG. 7 is a view illustrating one example of the data table stored in the storage device 23. In the data table illustrated in FIG. 7, information on the walk training apparatus 10 included in the management system 1 is registered.

More specifically, in the data table, identification information on the walk training apparatus 10, a threshold assigned to the walk training apparatus 10, and notification destination information are registered. The threshold is a value based on durability of the connecting tool. The threshold can be determined based on degrees of breakage, deterioration, raveling, and so on obtained by a durability test of the connecting tool. For example, the threshold can be set to be dozens of times to several hundred times as large as the predetermined load. The threshold is used at the time when a timing of maintenance of the walk training apparatus 10 is determined.

The notification destination information is information indicative of a destination to be notified that the timing of maintenance of the walk training apparatus 10 has come. For example, as the notification destination information, contact information or the like of a company that performs maintenance of the walk training apparatus 10 can be employed.

The processor 21 is a device configured to read out a program from the storage device 23 and execute the program. Concrete examples of the processor 21 include various processors such as a CPU or a MPU. Programs to be executed by the processor 21 include a timing determination portion 210 and a notification portion 211. Note that these programs may be executed by an integrated circuit such as an FPGA or an ASIC. The management apparatus 20, the processor 21, and the integrated circuit correspond to a computer.

The timing determination portion 210 is a program configured to determine that the timing of maintenance of the walk training apparatus 10 has come, in a case where the evaluation value based on which a load applied to the walk training apparatus 10 by the user is evaluated is equal to or more than a threshold associated with the walk training apparatus 10. In the present embodiment, the timing determination portion 210 compares an integrated load based on the number of times of the fall of the user and the predetermined load with the threshold associated with the walk training apparatus 10, and in a case where the integrated load is equal to or more than the threshold, the timing determination portion 210 determines that the timing of maintenance of the walk training apparatus 10 has come. The timing determination portion 210, the processor 21 configured to implement the timing determination portion 210, and the management apparatus 20 including the processor 21, correspond to a timing determination portion.

The notification portion 211 is a program configured to notify the notification destination apparatus 30 that the timing of maintenance of the walk training apparatus 10 has come.

Figure 8:
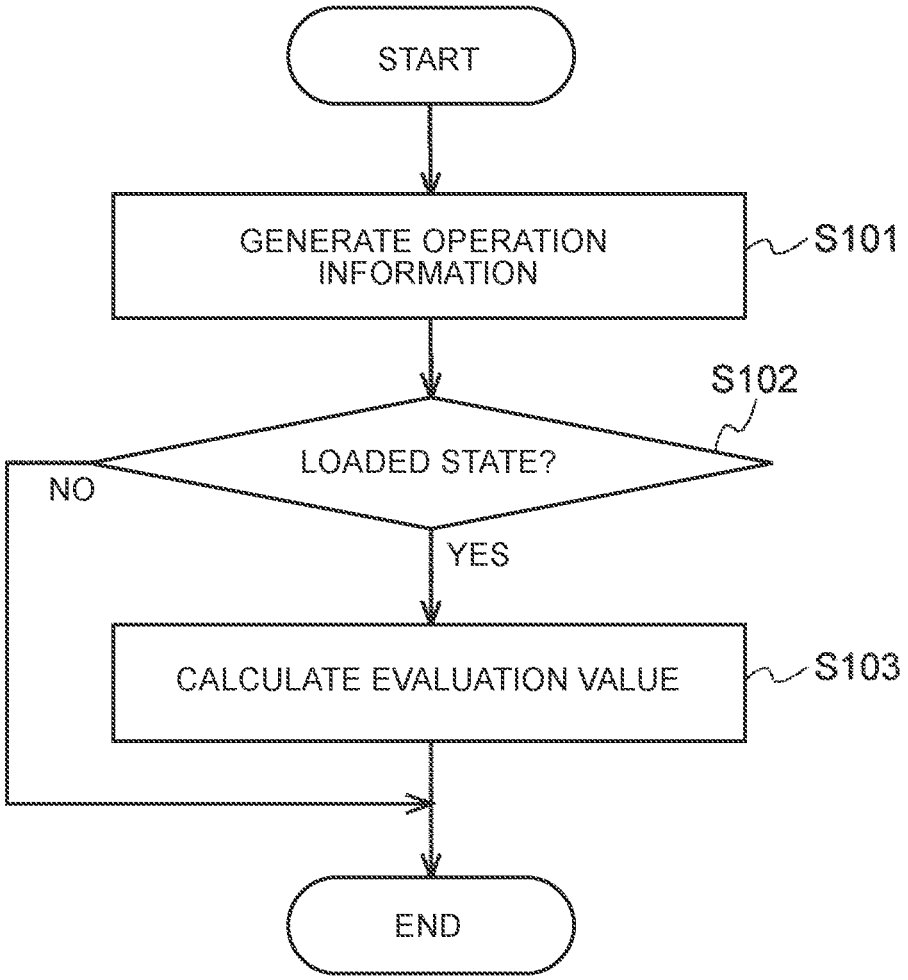
FIG. 8 is a flowchart illustrating a process to be executed by the walk training apparatus according to one aspect of the present disclosure.

FIG. 8 is a flowchart illustrating a process to be executed by the walk training apparatus 10. The walk training apparatus 10 can execute the process of FIG. 8 repeatedly.

In step S101, the operation information generation device 17 generates operation information on the user using the walk training apparatus 10. In step S102, the state detecting portion 121 of the control device 12 determines whether or not a loaded state is detected or not, by use of the operation information generated by the operation information generation device 17. In a case where the loaded state is not detected (NO), the process of FIG. 8 is ended. In the meantime, in a case where the loaded state is detected (YES), the process proceeds to step S103. In step S103, the evaluation value calculating portion 122 of the control device 12 calculates an evaluation value, and the process of FIG. 8 is ended.

Figure 9:
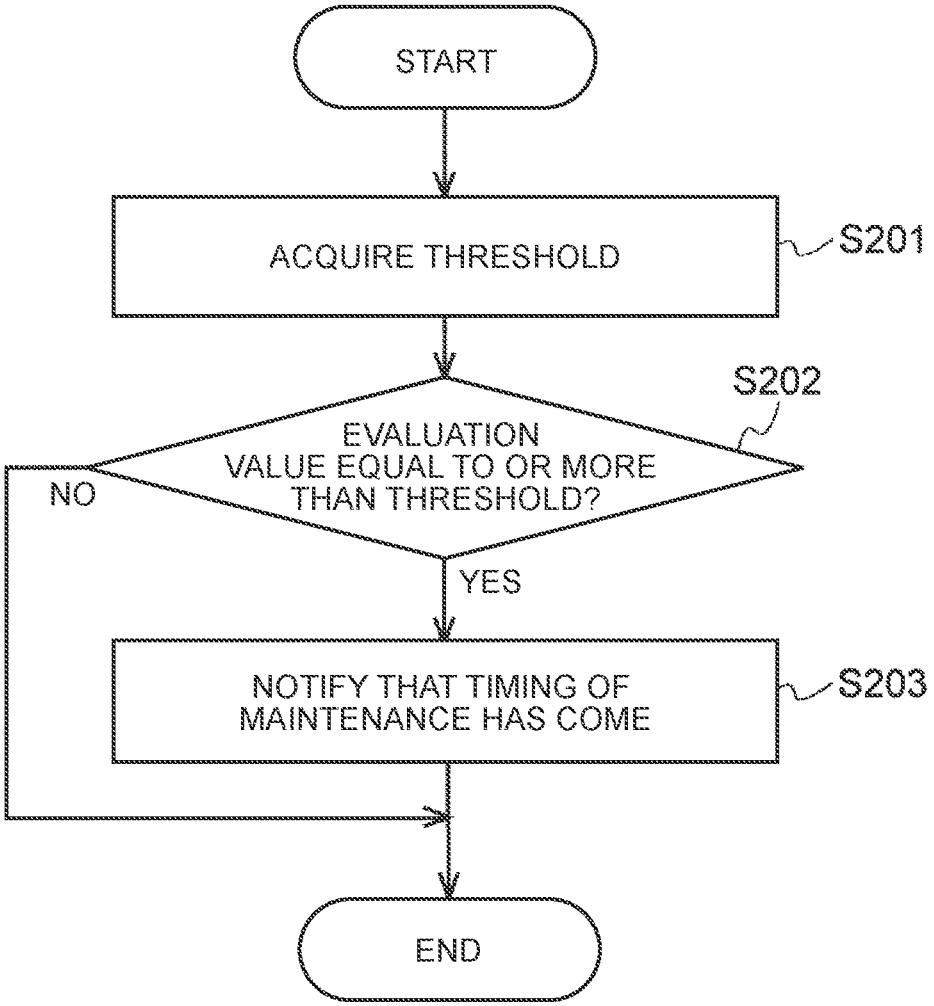
FIG. 9 is a flowchart illustrating a process to be executed by the management apparatus according to one aspect of the present disclosure.

FIG. 9 is a flowchart illustrating a process to be executed by the management apparatus 20. When the management apparatus 20 receives log information from the walk training apparatus 10, the management apparatus 20 can execute the process of FIG. 9.

In step S201, the timing determination portion 210 of the management apparatus 20 acquires, from the storage device 23, a threshold associated with the identification information on the walk training apparatus 10 that is included in the received log information. In step S202, the timing determination portion 210 determines whether the evaluation value included in the received log information is equal to or more than the acquired threshold or not. In a case where the evaluation value is less than the threshold (NO), the process of FIG. 9 is ended. In the meantime, in a case where the evaluation value is equal to or more than the threshold (YES), the notification portion 211 notifies, in step S203, the notification destination apparatus 30 that the timing of maintenance of the walk training apparatus 10 that has transmitted the log information has come, and the process of FIG. 9 is ended.

In the above embodiment, the state detecting portion 121 detects a fall of the user during use of the walk training apparatus 10. Subsequently, the evaluation value calculating portion 122 calculates an evaluation value based on which a load applied to the walk training apparatus 10 by the user is evaluated. In a case where the evaluation value is equal to or more than the threshold associated with the walk training apparatus 10, the timing determination portion 210 determines that the timing of maintenance of the walk training apparatus 10 has come. Hereby, the timing determination portion 210 can determine the timing of maintenance of the walk training apparatus 10.

Further, in the above embodiment, the state detecting portion 121 detects a fall of the user during use of the walk training apparatus 10. The evaluation value is an integrated load based on the number of times of the fall of the user and a predetermined load. Hereby, the timing determination portion 210 can determine that the timing of maintenance of the walk training apparatus 10 has come, based on the integrated load based on the number of times of the fall of the user and the predetermined load.

Further, the predetermined load is equal to or more than a load that can be applied by the user to the connecting tool via which the user is connected to the walk training apparatus 10. Hereby, the timing determination portion 210 can determine that the timing of maintenance of the connecting tool of the walk training apparatus 10 has come, based on the load that can be applied to the connecting tool by the user.

Further, the threshold is a value based on the durability of the connecting tool. Hereby, the timing determination portion 210 can determine that the timing of maintenance of the connecting tool has come, based on the curability of the connecting tool.

Further, the state detecting portion 121 can detect the fall of the user based on a posture change of the user by use of the captured image of the user using the walk training apparatus 10. Hereby, the state detecting portion 121 can detect the fall of the user based on the posture change of the user, thereby making it possible to accurately detect the state where the user has fallen down.

Further, the state detecting portion 121 can detect the fall of the user based on a change in the load of the user that is output from the load measurement device 161 configured to measure the load of the user. By using both of this detecting means and the detecting means configured to detect the fall of the user based on the captured image of the user using the walk training apparatus 10, it is possible to increase the detection accuracy of the fall of the user.

Further, the state detecting portion can detect the fall of the user based on a load applied to the suspension relief device 14 configured to support the user via the connecting tool attached to the user. Hereby, it is possible to raise the detection accuracy of the fall of the user.

In another embodiment, as the evaluation value, it is possible to employ an integrated load based on the number of times of the fall of the user and the load applied to the walk training apparatus 10 at the time of the fall. The load applied to the walk training apparatus 10 by the user at the time of the fall can be measured by the suspension relief device 14. Further, the load applied to the walk training apparatus 10 by the user at the time of the fall can be calculated by subtracting a load measured by the load measurement device 161 from the known weight of the user. It is preferable to employ the load applied by the user to the connecting tool via which the user is connected to the walk training apparatus 10, as the load applied to the walk training apparatus 10 by the user at the time of the fall.

Hereby, the timing determination portion 210 can determine the timing of maintenance of the walk training apparatus 10 based on a load actually applied to the walk training apparatus 10 by the user at the time of the fall.

Further, in another embodiment, the number of times of the fall of the user can be employed as the evaluation value. In this case, the walk training apparatus 10 transmits the identification information on the walk training apparatus 10 and the number of times of the fall of the user to the management apparatus 20 as the log information. As the threshold used to determine the timing of maintenance of the walk training apparatus 10, the number of times of the fall of the user based on the durability of the connecting tool can be employed. The number of times of the fall of the user based on the durability of the connecting tool can be obtained by a durability test of the connecting tool.

Further, in another embodiment, the walk training apparatus 10 may execute the function of the management apparatus 20. More specifically, the walk training apparatus 10 determines a timing of maintenance of the walk training apparatus 10, and in a case where the timing of maintenance of the walk training apparatus 10 has come, the walk training apparatus 10 can transmit a notification of the timing to the notification destination apparatus 30.

A program according to one embodiment of the present disclosure includes an instruction group (or a software code) to cause a computer to execute one or more functions described in the embodiment in a case where the instruction group is read by a computer. The program may be stored in a non-transitory computer readable medium or a substantial storage medium. Examples of the computer readable medium or the substantial storage medium include: memory technologies such as a random-access memory (RAM), a read-only memory (ROM), a flash memory, and a solid-state drive (SSD); optical disk storages such as a CD-ROM, a digital versatile disk (DVD), and a Blu-ray (registered trademark) disc; and magnetic storage devices such as a magnetic cassette, a magnetic tape, and a magnetic disk storage. However, the computer readable medium or the substantial storage medium is not limited to them. The program may be transmitted by a transitory computer readable medium or a communication medium. Examples of the transitory computer readable medium or the communication medium include transmission signals in an electrical form, an optical form, an acoustic form, and other forms. However, the transitory computer readable medium or the communication medium is not limited to them.

The present disclosure is not limited to the above embodiments, and various modifications can be made within a range that does not deviate from the gist of the present disclosure.

What is claimed is:

1. A management system for managing a walk training apparatus for a user to perform walking training, the management system comprising:

a state detecting portion configured to detect a loaded state in which the user applies a load to the walk training apparatus during use of the walk training apparatus;

an evaluation value calculating portion configured to calculate an evaluation value based on which the load applied to the walk training apparatus by the user is evaluated; and a timing determination portion configured to, in a case where the evaluation value is equal to or more than a threshold associated with the walk training apparatus, determine that a timing of maintenance of the walk training apparatus has come, wherein the state detecting portion detects a fall of the user during use of the walk training apparatus, the evaluation value is an integrated load based on a number of times of the fall of the user and a predetermined load, the predetermined load is equal to or more than the load to be applied by the user to a connecting tool via which the user is connected to the walk training apparatus, and the threshold is an integrated load capacity corresponding to the number of times of the fall of the user based on a durability of the connecting tool.

2. The management system according to claim 1, wherein the load applied to the walk training apparatus is the load applied by the user to the connecting tool via which the user is connected to the walk training apparatus.

3. The management system according to claim 1, wherein the state detecting portion detects the loaded state based on a posture change of the user by use of a captured image of the user using the walk training apparatus.

4. The management system according to claim 1, wherein the state detecting portion detects the loaded state based on a change in the load of the user, the load being output from a load measurement device configured to measure the load of the user.

5. The management system according to claim 1, wherein:

the walk training apparatus includes a supporting device configured to support the user from an upper side via the connecting tool attached to the user; and the state detecting portion detects the loaded state based on the load applied by the user to the supporting device via the connecting tool.

6. A method comprising:

detecting, via a computer, a loaded state in which a user applies a load to a walk training apparatus during use of the walk training apparatus;

calculating, via the computer, an evaluation value based on which the load applied by the user to the walk training apparatus is evaluated;

determining, via the computer, that a timing of maintenance of the walk training apparatus has come, in a case where the evaluation value is equal to or more than a threshold associated with the walk training apparatus; and detecting, via the computer, a fall of the user during use of the walk training apparatus, wherein the evaluation value is an integrated load based on a number of times of the fall of the user and a predetermined load, the predetermined load is equal to or more than the load to be applied by the user to a connecting tool via which the user is connected to the walk training apparatus, and the threshold is an integrated load capacity corresponding to the number of times of the fall of the user based on a durability of the connecting tool.

7. The method according to claim 6, wherein the load applied to the walk training apparatus is the load applied by the user to the connecting tool via which the user is connected to the walk training apparatus.

8. The method according to claim 6, further comprising detecting, via the computer, the loaded state based on a posture change of the user by use of a captured image of the user using the walk training apparatus.

9. The method according to claim 6, further comprising detecting, via the computer, the loaded state based on a change in the load of the user, the load being output from a load measurement device configured to measure the load of the user.

10. The method according to claim 6, wherein:

the walk training apparatus includes a supporting device configured to support the user from an upper side via the connecting tool attached to the user; and the computer detects the loaded state based on the load applied by the user to the supporting device via the connecting tool.

11. A non-transitory computer-readable medium storing instructions that, when executed by one or more processors of a device, cause the device to:

detect a loaded state in which a user applies a load to a walk training apparatus during use of the walk training apparatus;

calculate an evaluation value based on which the load applied to the walk training apparatus by the user is evaluated;

in a case where the evaluation value is equal to or more than a threshold associated with the walk training apparatus, determine that a timing of maintenance of the walk training apparatus has come; and detect a fall of the user during use of the walk training apparatus, wherein the evaluation value is an integrated load based on a number of times of the fall of the user and a predetermined load, the predetermined load is equal to or more than the load to be applied by the user to a connecting tool via which the user is connected to the walk training apparatus, and the threshold is an integrated load capacity corresponding to the number of times of the fall of the user based on a durability of the connecting tool.

* * * * *